US005777579A

United States Patent [19]

Goetz et al.

[11] Patent Number: 5,777,579

[45] Date of Patent: Jul. 7, 1998

[54] LOW COST BUTLER MATRIX MODEFORMER CIRCUIT

[75] Inventors: Allan C. Goetz, La Jolla; Robert G. Riddle, II, San Diego, both of Calif.

[73] Assignee: TRW Inc., Redondo Beach, Calif.

[21] Appl. No.: 799,750

[22] Filed: Feb. 13, 1997

[51] Int. Cl.[6] ..... H01Q 3/22; H01Q 3/24; H01Q 3/26

[52] U.S. Cl. ..... 342/373

[58] Field of Search ..... 342/373

[56] References Cited

U.S. PATENT DOCUMENTS

| | | | |
|---|---|---|---|
| 4,231,040 | 10/1980 | Walker . | |
| 4,633,259 | 12/1986 | Hrycak | 342/373 |
| 4,638,317 | 1/1987 | Evans | 342/373 |
| 5,373,299 | 12/1994 | Ozaki et al. | 342/373 |
| 5,561,667 | 10/1996 | Gerlach | 342/373 |

*Primary Examiner*—Theodore M. Blum
*Attorney, Agent, or Firm*—Michael S. Yatsko

[57] ABSTRACT

An implementation of a Butler matrix transformation used to process antenna signals and, in particular, to transform signals obtained from an N-port antenna into mode signals used for direction finding and other purposes. A reverse transformation is used when the antenna is operating in a transmit mode. Instead of using a single Nth order transformation matrix, the circuit of the invention employs a decomposed form of the transformation matrix, thereby reducing the complexity of the transformation by using lower-order matrices. In an example of the invention for an 8×8 transformation, the circuit complexity is further reduced by using an additional level of decomposition, in which phase shifting is effected by a circuit implementation of a single 8×8 diagonal phase shift matrix requiring only three phase shift circuits. Reduction in circuit complexity, particularly in the number of phase shift circuits, reduces bias errors in the overall transformation and reduces fabrication cost.

2 Claims, 2 Drawing Sheets

LOW COST BUTLER MATRIX MODEFORMER CIRCUIT

BACKGROUND OF THE INVENTION

This invention relates generally to antenna signal processing circuitry and, more particularly, to modeformer circuits of the Butler matrix type. Multi-port analog modeformers are widely used in microwave antenna feed systems to convert signals from N ports of an antenna to M receive/transmit ports used to carry separate signals or to determine the direction of a received signal. The voltages from antenna systems that have N-fold cylindrical symmetry about some axis produce particularly simple and useful analytic signals (or modes) when they are processed by an N-port modeformer using weights that make use of the N-fold symmetry. In the example given in this specification, N and M are equal, and the modeformer performs the function of converting the multiple antenna port signals, or "arm" signals, into an equal number of "mode" signals used for simplified direction finding and other purposes. Antennas that have N arms, where N is a power of 2, have used the Butler matrix for the modeformer function. However, as the number of arms increases the traditional Butler matrix modeformer circuit becomes complex and expensive to produce. A less complex circuit that is made of easily manufactured radio-frequency (RF) components is needed.

The design goal of an analog modeformer is to provide a set of complex weights in a matrix, referred to herein as the FN matrix, that is multiplied by the N analytic antenna arm signals to provide the desired N mode signals. Thus the basic operation of the modeformer can be represented as a simple matrix multiplication:

$$(\text{mode signals})=FN*(\text{arm signals}),$$

where FN is an N×N complex matrix, the elements of which are given by:

$$(FN_{mn})=\frac{1}{\sqrt{N}}\,e^{im*n*\frac{2\pi}{N}},\ \text{where } m,\ n=0 \text{ to } N-1. \tag{1}$$

The FN matrix is sometimes called the Fourier matrix, and the mode signals and arm signals are each (N×1) column vectors with complex elements. Analog modeformers of the Butler matrix type typically include a number of 90° or 180° hybrid couplers along with a number of fixed phase shifters, which are usually electronically interconnected via phase-trimmed coaxial cables. Because modeformers must operate at microwave frequencies, it is not practical to convert the received signals to digital form, and then implement the required conversion matrix as a digital processor. However, the components of an analog modeformer necessarily introduce bias errors into the conversion process, especially if the modeformer must operate over a wide frequency range. The bias errors in the modeformer cause the modeforming weights to deviate from the ideal (FN matrix) weights, and the modes that are produced to differ from the ideal modes. The phase characteristics of the modes may not vary linearly with the azimuth angle and the amplitudes may not be constant when the antenna is rotated about its axis of symmetry.

U.S. Pat. No. 5,373,299 to Ozaki et al. discloses and claims an improved modeformer of the Butler matrix type, but is typical in that it includes a number of phase shifters and hybrid couplers. It is known that phase shifters are the source of most of the bias error in Butler matrix modeformers. Moreover, phase shifters contribute significantly to the fabrication cost. Accordingly, there is a need for a modeformer circuit that drastically reduces the number of required phase shifters and thereby provides improved performance at reduced cost. The present invention is directed to these ends.

SUMMARY OF THE INVENTION

The present invention resides in a Butler matrix modeforming circuit having significantly reduced circuit complexity and, therefore, improved performance and lower manufacturing cost. Briefly, and in general terms, the modeforming circuit, which transforms N analytic signals appearing at antenna ports to N mode signals, comprises a first circuit implementing a decomposed matrix of Nth order, comprising two matrices of (N/2)th order; a second circuit implementing a second matrix of Nth order, comprising two diagonal phase shift matrices of (N/2)th order; and a third circuit implementing a third matrix of Nth order, which is cascaded with the first and second circuits to produce the desired Butler matrix transformation with reduced circuit complexity.

In one specific form of the invention, the second circuit, instead of having two diagonal phase shift matrices, is implemented as four interconnected circuit modules, including a first circuit module implementing an Nth order diagonal phase shift matrix and three additional circuit modules each implementing an Nth order matrix. This second level of matrix decomposition further reduces circuit complexity and cost. Matrices that contain only ones represent coaxial interconnects and to not need complex circuits to implement.

It will be appreciated from the foregoing that the present invention represents a significant advance in the field of antenna signal processing. In particular, the invention provides a modified form of the Butler matrix transformation that has significantly reduced circuit complexity, improved performance, and reduced fabrication cost. Other aspects and advantages of the invention will become apparent from the following more detailed description.

DESCRIPTION OF THE PREFERRED EMBODIMENT

Figure 1:
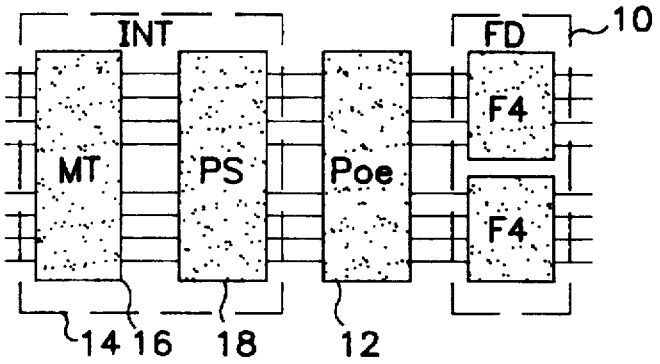
FIG. 1 is a diagrammatic view of a Butler matrix transformation circuit in accordance with the present invention.
Figure 2:
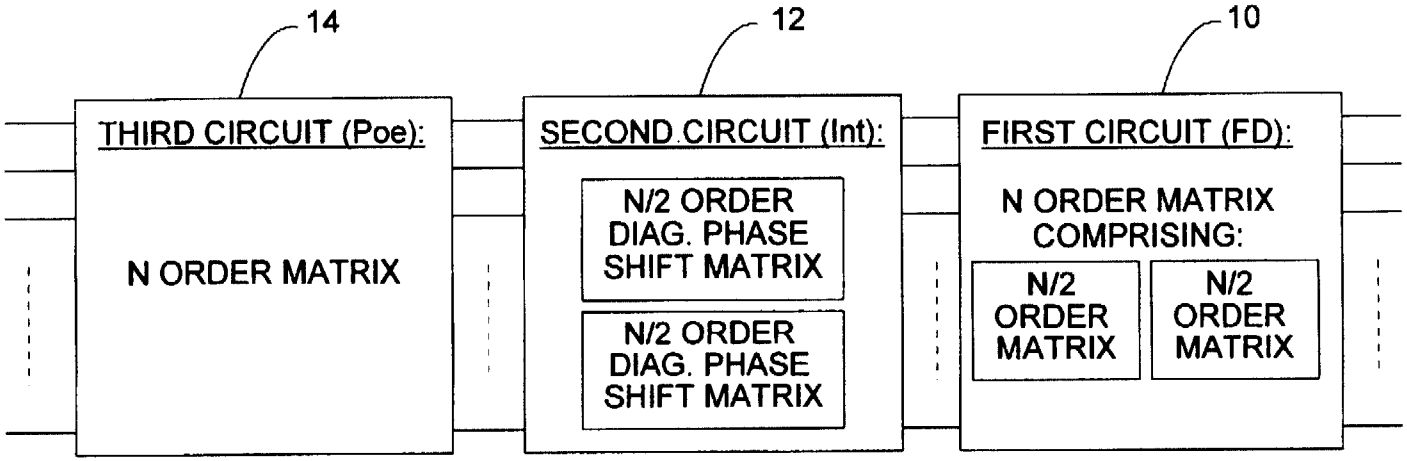
FIG. 2 is a block diagram of the Butler matrix transformation circuit of the invention.

In accordance with the present invention, the basic transformation matrix given in equation (1) above is implemented with a minimum of complex circuitry and is based on a decomposition of the matrix FN as follows:

$$FN=Int\cdot FD\cdot Poe, \tag{2}$$

where Int, FD and Poe are N×N matrices.

In equation (2), is given by:

$$FD=\begin{pmatrix} F(N/2) & 0 \\ 0 & F(N/2) \end{pmatrix}.$$

For N=8:

$$Poe=\begin{pmatrix}1&0&0&0&0&0&0&0\\0&0&1&0&0&0&0&0\\0&0&0&0&1&0&0&0\\0&0&0&0&0&0&1&0\\0&1&0&0&0&0&0&0\\0&0&0&1&0&0&0&0\\0&0&0&0&0&1&0&0\\0&0&0&0&0&0&0&1\end{pmatrix}\text{ and } FD=\begin{pmatrix}F4&0\\0&F4\end{pmatrix},\text{ and } Int=$$

$$\begin{pmatrix}I&D4\\I&-D4\end{pmatrix},\text{ and } D4=\begin{pmatrix}1&0&0&0\\0&e^{2\pi i*\frac{1}{8}}&0&0\\0&0&e^{2\pi i*\frac{2}{8}}&0\\0&0&0&e^{2\pi i*\frac{3}{8}}\end{pmatrix}.$$

Equation (2) is the same decomposition that is used in the Fast Fourier Transform (FFT), attributed Cooley-Tukey, but has not previously been applied to analog modeformers.

For a minimum hardware implementation of the F8 matrix, a further decomposition of Int in equation (2) is required, as follows:

$$Int=poe4*MT*PS*poe5 \tag{3}$$

where:

$$poe4=\begin{pmatrix}0&1&0&0&0&0&0&0\\0&0&0&1&0&0&0&0\\0&0&0&0&0&1&0&0\\0&0&0&0&0&0&0&1\\1&0&0&0&0&0&0&0\\0&0&1&0&0&0&0&0\\0&0&0&0&1&0&0&0\\0&0&0&0&0&0&1&0\end{pmatrix},$$

$$MT=\begin{pmatrix}1&-1&0&0&0&0&0&0\\1&1&0&0&0&0&0&0\\0&0&1&-1&0&0&0&0\\0&0&1&1&0&0&0&0\\0&0&0&0&1&-1&0&0\\0&0&0&1&1&1&0&0\\0&0&0&0&0&0&1&-1\\0&0&0&0&0&0&1&1\end{pmatrix},$$

$$PS=\begin{pmatrix}1&0&0&0&0&0&0&0\\0&1&0&0&0&0&0&0\\0&0&1&0&0&0&0&0\\0&0&0&1&0&0&0&0\\0&0&0&0&1&0&0&0\\0&0&0&1&0&e^{\frac{i\pi}{4}}&0&0\\0&0&0&0&0&0&e^{\frac{i\pi}{2}}&0\\0&0&0&0&0&0&0&e^{\frac{i3\pi}{4}}\end{pmatrix}\text{ and}$$

-continued $$poe5=\begin{pmatrix}1&0&0&0&0&0&0&0\\0&0&0&0&1&0&0&0\\0&1&0&0&0&0&0&0\\0&0&0&0&0&1&0&0\\0&0&1&0&0&0&0&0\\0&0&0&0&0&0&1&0\\0&0&0&1&0&0&0&0\\0&0&0&0&0&0&0&1\end{pmatrix}.$$

Equation (3) shows that the matrix transformation Int can be implemented using simple printed circuit magic-T inverter circuit blocks (one of which is represented by the 2×2 sub-matrices on the diagonal of MT), interconnecting transmission lines and differential phase shifters. The differential phase shifters, characterized by the PS matrix, provide constant phase lead with respect to a reference transmission line. Phase shifts of $\pi/2$ and $\pi/4$ are realized by cascading $\pi/4$ phase shifter sections. Since phase shifters are the source of most of the bias error and fabrication cost of any modeformer, using a minimal number of phase shifters in this manner greatly reduces bias error and fabrication cost.

The FD matrix consists of two F4 matrices symmetrically mapped along the diagonal of an 8×8 matrix, as follows:

$$Fd=\begin{pmatrix}F4&0\\0&F4\end{pmatrix}=\begin{pmatrix}1&1&1&1&0&0&0&0\\1&i&-1&-i&0&0&0&0\\1&-1&1&-1&0&0&0&0\\1&-i&-1&i&0&0&0&0\\0&0&0&0&1&1&1&1\\0&0&0&0&1&i&-1&-i\\0&0&0&0&1&-1&1&-1\\0&0&0&0&1&-i&-1&i\end{pmatrix},$$

$$\text{where: } F4=\begin{pmatrix}1&1&1&1\\1&i&-1&-i\\1&-1&1&-1\\1&-i&-1&i\end{pmatrix}.$$

The F4 circuits are implemented using passive quadrature couplers and magic-T hybrid components.

The first level of decomposition of the FN matrix defined by equation (2) reduces the overall transformation process to a number of (N/2)th order matrices, interconnection circuitry and a simple diagonal phase shift matrix. Sparse matrices (i.e. mostly zeros) can be realized using a small number of circuit components, so that equation (2) represents a decomposition that uses the smallest number of circuit components. The two D4 matrices require a total of six phase shifters. A smaller number than needed for the conventional Butler matrix implementation, even with the improvements of Ozaki et al. (5,373,299).

The decomposition of the FN matrix defined by equation (3) further reduces the complexity of the circuitry and the sparse matrices show the small number of circuit components required. The PS matrix in equation (3) requires only three phase shifters, two of which (for shifts of $\pi/2$ and $3\pi/4$) may be conveniently implemented by cascading multiple instances of a $\pi/4$ phase shifter.

Equation (3) may take different forms from the one illustrated. For example, the order of the matrices poe4, MT, PS and poe5 may be rearranged without departing from the principles of the invention. In these matrices, those with +1's as elements are simply interconnect diagrams, the −1 elements are 180° phase shifts, and the other non-zero terms elements are other phase shifts. Since each non-zero matrix element is either an interconnect or a basic RF phase shift circuit, the number of non-zero elements of the matrices is indicative of the circuit complexity. It will be observed that the total number of non-zero elements in the decomposition of the Int matrix is the same as the number of non-zero elements in the original Int matrix. For the case of N=8, as illustrated, this number is 40. In general, any decomposition of the Int matrix having the same total number of non-zero elements as the original Int matrix, would provide the desired minimization of the number of components.

Theoretical verification of the matrix decomposition defined by equation (3) was initially obtained using the MATLAB symbolic toolbox. This product manipulates symbols and can perform all of the algebraic and matrix functions that are performed by the corresponding analog circuits of the modeformer. A program listing is provided below immediately preceding the claims. The program verifies that the decomposition is correct and uses a 4×4 matrix decomposition to model the transformation. That is, Poe1 is a 4×4 matrix component of a larger 8×8 matrix. Equation (2) is based on a standard reference: Strang, G. *Introduction to Linear Algebra*, Wellesley-Cambridge Press, 1993, pp. 422–23.

FIG. 1 shows the modeformer hardware of the invention in diagrammatic form, including the three principal matrices FD, indicated by reference numeral 10, the Poe matrix 12 and the Int matrix 14, interconnected by transmission lines indicated by horizontal lines. The Int matrix 14 is shown as including the MT matrix 16 and the PS matrix 18, in accordance with equation (3).

The modeformer of the present invention performs the same function as the conventional Butler matrix but with a cost reduction that can be attributed to: (a) use of standard, off-the-shelf architecture and components in approximately 80% of the parts, (b) reduction in the number of parts overall, and (c) reduction in the amount of "touch" labor required to fabricate and assemble the modeformer. Touch labor is a major cost and is used for many operations during the manufacture of modeformers. For instance, each differential phase shifter's coupled transmission lines must be "shorted" at their ends for proper operation. By reducing the number of phase shifters used in the modeforming network, the present invention reduces the errors potentially introduced by soldering operations on the transmission lines associated with the phase shifters.

In Table 1 below, the parts counts are given for three types of modeformers: the modeformer of the present invention, the Ozaki modeformer discussed above, and another modeformer of the Butler matrix type, designated as AIL PN-461467. The table shows that the modeformer of the invention has 35% fewer parts, and that the parts that have been eliminated were the more complex and expensive phase shifters.

TABLE 1

| Modeformer Type | 90° or 180° Hybrids | 45° Phase Shifter | Total Components |
|---|---|---|---|
| Present Invention | 12 | 6 | 18 |
| Ozaki 8 × 8 | 12 | 16 | 28 |
| AIL PN-461467 | 12 | 16 | 28 |

The present invention represents a significant advance in antenna signal processing. In particular, the invention provides a novel implementation of the Butler matrix that greatly reduces circuit complexity, bias errors, and fabrication cost. Although a specific embodiment of the invention has been described in detail for purposes of illustration, various modifications may be made without departing from the spirit and scope of the invention. Accordingly, the invention should not be limited except as by the appended claims.

MATLAB Program' Listing

```
%                    CT_FT.m
%This program tests the CT decomposition of the F matrix using the
symbolic
%matrix multiplication
F8_=sym(8,8, 'm','n','exp(i*2pi*(m-1)*/8');      %a=1/sqrt(8)
A=sym(['[a0000000;0a000000;00a00000;000a0000;0000a000;'...
      '00000a00;000000a0;0000000a]']);
F8=symmul(F8_,A);
F4=sym(4,4,'m','n',exp(i*2*pi*(m-1)*(n-1)/4');
B=sym('[b000;0b00;00b0;000b]');
F4=symmul(F4_,B);
Poe=sym(['[10000000;00100000;00001000;00000010;'...
      '01000000;0001000;00000100;00000001]']);
Poe1=sym('[1000;0010;0000;0000]')
Poe2=sym('[0000;0000;1000;0010]')
Poe3=sym('[0100;0001;0000;0000]')
Poe4=sym('[0000;0000;0100;0001]')
Poe=sym('[Poe1 Poe2; Poe3 Poe4]');
D4_=sym(4,4,'0');
I=sym(4,4,'0');
I=sym(I,1,1,'1');
I=sym(I,2,2,'1');
I=sym(I,3,3,'1');
I=sym(I,4,4,'1');
D4_=sym(D4_,1,1,'1')
D4_=sym(D4_2,2,'exp(2*pi*i*1/8)');
D4_=sym(D4_3,3,'exp(2*pi*i*2/8)');
D4_=sym(D4_4,4,'exp(2*pi*i*3/8)');
Int=sym('[I D4_; I -D4_]');
MFN=sym('[F4_0; 0 F4_]');
temp=symmul(MFN,Poe_); F8_test=symmul(Int,temp);
F8_test1=symop(I,'*',F4_,'*',Poe1,'+',D4_,'*',F4_,'*',Poe3);
F8_test2=symop(I,'*',F4_,'*',Poe2,'+',D4_,'*',F4_,'*',Poe4);
F8_test3=symop(I,'*',F4_,'*',Poe1,'+',D4_,'*',F4_,'*',Poe3);
F8_test4=symop(I,'*',F4_,'*',Poe2,'+',D4_,'*',F4_,'*',Poe4);
```

What is claimed is:

1. An antenna modeforming circuit with reduced circuit complexity, for transforming N analytic signals appearing at antenna ports to N mode signals, where N is a power of two, the modeforming circuit comprising:

a first circuit implementing a matrix manipulation by a decomposed matrix of Nth order, comprising two matrices of (N/2)th order;

a second circuit implementing a matrix manipulation by a second matrix of Nth order, comprising two diagonal phase shift matrices of (N/2)th order; and a third circuit implementing a matrix manipulation by a third matrix of Nth order, which is cascaded with the first and second circuits to produce a desired Butler matrix transformation with fewer circuit components.

2. An antenna modeforming circuit with reduced circuit complexity, for transforming N analytic signals appearing at antenna ports to N mode signals, where N is a power of two, the modeforming circuit comprising:

a first circuit implementing a matrix manipulation by a decomposed matrix of Nth order, comprising two matrices of (N/2)th order;

a second circuit implemented as four interconnected circuit modules, including a first circuit module implementing a matrix manipulation by an Nth order diagonal phase shift matrix and three additional circuit modules each implementing a matrix manipulation by an Nth order matrix; and a third circuit implementing a matrix manipulation by a further matrix of Nth order, which is cascaded with the first and second circuits to produce a desired Butler matrix transformation with fewer circuit components.

* * * * *